US006820703B1

(12) United States Patent
Borg

(10) Patent No.: US 6,820,703 B1
(45) Date of Patent: Nov. 23, 2004

(54) LOCKING DEVICE FOR A WIRE LINE CORE DRILLING SYSTEM AND A METHOD FOR CORE DRILLING

(75) Inventor: Thomas Borg, Stocksund (SE)

(73) Assignee: Atlas Copco Craelius AB, Marsta (SE)

( * ) Notice: Subject to any disclaimer, the term of this patent is extended or adjusted under 35 U.S.C. 154(b) by 0 days.

(21) Appl. No.: 10/069,258

(22) PCT Filed: Aug. 24, 2000

(86) PCT No.: PCT/SE00/01630

§ 371 (c)(1),
(2), (4) Date: Feb. 21, 2002

(87) PCT Pub. No.: WO01/14689

PCT Pub. Date: Mar. 1, 2001

(30) Foreign Application Priority Data

Aug. 24, 1999 (SE) ..... 9903018

(51) Int. Cl.[7] ..... E21B 25/02; E21B 25/00
(52) U.S. Cl. ..... 175/58; 175/246; 175/236
(58) Field of Search ..... 175/236, 58, 246, 175/247, 251, 253, 320

(56) References Cited

U.S. PATENT DOCUMENTS 2,019,176 A * 10/1935 Dodds ..... 175/253
2,073,263 A * 3/1937 Hohmann et al. ..... 175/60
3,567,269 A 3/1971 Jensen
3,610,675 A * 10/1971 Jensen ..... 294/86.19
3,701,389 A * 10/1972 Egnelov et al. ..... 175/246
3,739,865 A * 6/1973 Wolda ..... 175/244
3,777,826 A 12/1973 Wolda
4,187,919 A * 2/1980 Lambot ..... 175/246
4,466,497 A * 8/1984 Soinski et al. ..... 175/246
4,834,198 A * 5/1989 Thompson ..... 175/244
5,799,742 A 9/1998 Soinski et al.
5,934,393 A * 8/1999 Marshall ..... 175/236

FOREIGN PATENT DOCUMENTS

GB 992246 5/1965

* cited by examiner

*Primary Examiner*—David Bagnell
*Assistant Examiner*—Shane Bomar
(74) *Attorney, Agent, or Firm*—Barnes & Thornburg

(57) ABSTRACT

The present invention relates to a locking device (4) for a wire line core drilling system comprising an inner tube (2) by means of which core samples are collected, and an outer tube (1) connected to a drill bit, which locking device is applied in the rear end of the inner tube. The locking device (4) comprises locking members (7, 9) so designed that, when the inner tube has been inserted into the outer tube and has assumed the correct position inside the outer tube for drilling, in one and the same movement it simultaneously effects mechanical locking of the inner tube (2) in relation to the outer tube (1) and release of a gripping means (10; 25) of an accompanying device (5; 26) connected to the inner tube.

18 Claims, 2 Drawing Sheets

LOCKING DEVICE FOR A WIRE LINE CORE DRILLING SYSTEM AND A METHOD FOR CORE DRILLING

CROSS-REFERENCE TO RELATED APPLICATIONS

This application is a U.S. national counterpart application of international application serial No. PCT/SE00/01630 filed Aug. 24, 2000, which claims priority to Swedish application serial no. 9903018-1 filed Aug. 24, 1999.

FIELD OF THE INVENTION

The present invention relates to a locking device for a wire line core drilling system in accordance with the preamble to claim 1, a wire line core drilling system including a locking device in accordance with the preamble to claim 9, and a method of wire line core drilling in accordance with the preamble to claim 10.

BACKGROUND OF THE INVENTION

When performing exploratory drilling to collect rock samples from depths of from several hundred to a couple of thousand meters, double core tubes are used having an inner and an outer tube. The sample is collected in the inner tube, which usually has a length of a few meters. When the inner tube is full this is usually detected by means of a manometer or the like that measures the flushing water pressure in the core tube. A retriever device suspended on a wire is lowered into the tube for retracting the inner tube with the sample, said retriever device comprising a gripping means in the form of a claw or "spear head" arranged to engage with a gripping means arranged on/in the upper end of the inner tube. When the wire is then tautened the inner tube is disengaged from the outer tube, and the inner tube with the sample can be hoisted up. Conversely, the claw and gripping means on the inner tube can be used to lower a new inner tube. Equipment of this type is generally known as a wire line system.

When a new inner tube is inserted it is important to be able to ascertain that the inner tube really has reached right down to the bottom and has assumed its correct position for drilling, before drilling is commenced. Ascertainment that the tube cannot no longer move, but is firmly held is generally taken as an indication that the inner tube has reached its correct position. According to known technology, therefore, the gripping means is often designed to be combined with some type of locking member that firmly locks the inner tube in relation to the outer tube when the inner tube has reached the correct position. This locking member usually consists of a hook-like device, preferably spring-loaded, a locking claw or latch that engages with recesses or shoulders arranged in the inside of the outer tube. Actual insertion of the inner tube is usually performed by the inner tube being "pumped" along inside the drill string with the aid of water, and/or lowered with the aid of the force of gravity. In the case or horizontal, or substantially horizontal holes the tube must be pumped along. When the inner tube is firmly in place the water pressure will increase to such an extent that a valve arranged for flushing medium in the inner tube is released.

One problem with such known arrangements is that when the inner tube is inserted into the drill string, it sometimes catches before it has reached the correct position for drilling. With designs currently in use the increase in water pressure then occurring will release the flushing valve before the inner tube has reached its correct position and, in the worst case, drilling will be commenced. This primarily entails a disadvantage from the financial point of view since the drilling will be into thin air. The same thing may naturally occur when a tube that has been lowered by the force of gravity gets caught and drilling is commenced since it is assumed that the inner tube has reached the correct position for drilling. There is also a risk of the core at the bottom being destroyed.

When the inner tube is full and shall be retracted the locking means in the form of locking claws or latches retaining the inner tube in the outer tube must be disengaged from the outer tube. This is usually achieved by the retractor claw engaging with the gripping means connected to the locking device, the latches of which then being drawn in against the action of the spring force that is pressing them outwards to achieve locking against the outer tube. A certain reaction force is thus necessary in the system in order to overcome the spring force, which also increases the friction at the point where the latches hook into the outer tube. Currently the most usual known device for achieving this comprises a sleeve that contributes to compressing the latches from below so that they are released from the recesses, shoulders, or the like of the outer tube. Other devices used to achieve this are described, for instance, in U.S. Pat. No. 4,834,198 and Swedish patent No. 320 941. The latter particularly reveals the drawback that gripping means and locking member are only engaged at one point, which naturally rally easily leads to load imbalances and problems associated therewith. Due to the design of the known devices, as the placing of the springs and the various gripping and locking members, however, the problem sometimes arises that the locking member is not released from its engagement with the outer tube, remaining caught there and preventing the inner tube from being retracted with the core sample. This may result in extensive standstill costs, as well as other costs. In fact, the complete drill string must then be taken up and the wire must be cut in every joint of the drill string. This is extremely time-consuming and expensive.

SUMMARY OF THE INVENTION

The primary object of the present invention is to remedy the problems described above by means of a single device.

The object of the invention is achieved by means of a locking device as defined in the characterizing part of claim 1, a wire line core drilling system as described scribed in the characterizing part of claim 9, and a method as described in the characterizing part of claim 10.

In accordance with the present invention, thus, a locking device for an inner tube comprises locking members so designed that, when the inner tube has been inserted into the outer tube and has assumed the correct position inside the outer tube for drilling, in one and the same movement it simultaneously effects mechanical locking of the inner tube in relation to the outer tube and mechanical release of a gripping means of an accompanying device connected to the inner tube. The invention thus offers the advantages that the accompanying device is not released until the inner tube has assumed the correct position inside the outer tube for drilling. This is particularly advantageous if, for instance, the accompanying device comprises a valve for flushing medium, which is usual as described above. When the valve is released, this is achieved mechanically with the aid of the locking device in accordance with the invention. Thus, it is not released as a result of any pressure increase, and the risks entailed with previously known pressure-released arrangements, e.g. that the valve is released when the tube catches, are therefore eliminated. The locking device in accordance with the invention also has the advantage that it can be used together with an accompanying device consisting of an insertion device for inserting an inner tube into an outer tube in a dry drill hole. A corresponding method is defined in claim 10.

Preferably, the locking device in accordance with the invention also comprises gripping means which, when the inner tube is to be withdrawn from the outer tube with the aid of a retriever device comprising gripping means, and said gripping means of the retriever device come into contact with the gripping means of the locking device, in one and the same movement engage with the gripping means of the retriever device and simultaneously release the inner tube from its locked position in relation to the outer tube. The invention thus reveals the additional advantage that the locking device and catch are disengaged from each other at the same time as the inner tube is released from being locked in relation to the outer tube.

The present invention thus offers the important advantage of being able to fulfil both the functions described, and also of being able to be used both together with a flushing valve and in a dry drill hole. It constitutes a more reliable, simpler and more economic solution than has been available through known technology.

In accordance with a particularly preferred embodiment the locking device comprises at least two parts, each of which is journalled pivotably in the inner tube in radial direction about a shaft situated between rear protrusions and forward protrusions on respective parts. It is these protrusions that act as means for firmly locking the inner tube in relation to the outer tube, engage with gripping means on the retriever device and also firmly lock or release the accompanying device. These protrusions and other components of the invention will be described in the following detailed description with reference to the drawings.

The invention also relates to a wire line core drill system including such a locking device, as defined in claim 9.

Additional features and advantages are revealed in the dependent claims.

BRIEF DESCRIPTION OF THE DRAWINGS

The invention will now be described in detail with reference to the accompanying drawings, illustrating a non-limiting embodiment of the invention by way of example, in which.

DETAILED DESCRIPTIONS OF ILLUSTRATIVE EMBODIMENTS

Figure 1:
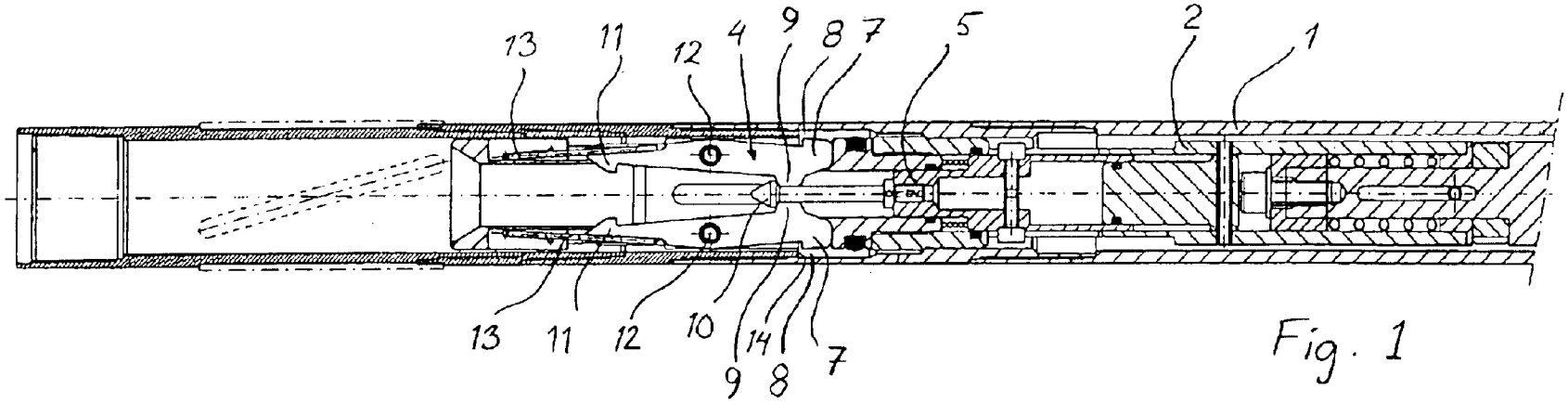
FIG. 1 shows a longitudinal section through a drill string provided with a locking device in accordance with the present invention, upon insertion of an inner tube.

The drill string in FIG. 1 thus comprises an outer tube 1 connected to a drill bit, and an inner tube 2, by means of which core samples are collected. Drilling is performed towards the right in the drawing, this being designated the forward direction. A locking device 4 is arranged in the rear part of the inner tube. A valve 5 for flushing medium is also arranged in the rear part of the inner tube. This valve may preferably be of the type that is the subject of the applicants own Swedish patent application, filed simultaneously with the present patent application. The flushing medium is generally water. When drilling in downward direction, the inner tube is usually inserted in the drill string by simply dropping it inside the drill string so that it falls by force of gravity until it reaches the correct position inside the outer tube for drilling. When this method cannot be used, e.g. when drilling substantially in horizontal direction or at various upward angles, the inner tube is pumped along inside the drill string with the aid of flushing medium, preferably water. FIG. 1 illustrates the position when the inner tube has just reached the correct position for drilling but has not yet been locked in relation to the outer tube.

In accordance with the embodiment illustrated by way of example, the locking device comprises two parts or halves, and each of these parts comprises two forward protrusions 7, preferably with hook-like shape, directed radially outwards, which are designed to engage with recesses 8 arranged on the inside of the outer tube. These forward protrusions 7 may be compared with the latches on previously known devices. The locking device is also provided with forward protrusions 9 directed radially inwards and designed to engage with a gripping means 10 connected to the movable part of the valve 5. The protrusions 9 may also be used to engage with a gripping means in an device for inserting an inner tube into a dry drill hole, as described below in conjunction with FIG. 4. Finally the locking device is also provided with rear protrusions 11, preferably with hook-like shape, directed radially inwards. These protrusions 11 are designed to engage with gripping means of a retriever device, as will be described in detail below with reference to FIG. 3.

The two parts of the locking device are spring-loaded and pivotably journalled in the inner tube about shafts 12 situated between the rear protrusions and the forward protrusions. The locking device can thus pivot in substantially radial direction, against the action of two springs 13, preferably wire springs. Each part can therefore be compared to a two-pronged lever.

Figure 2:
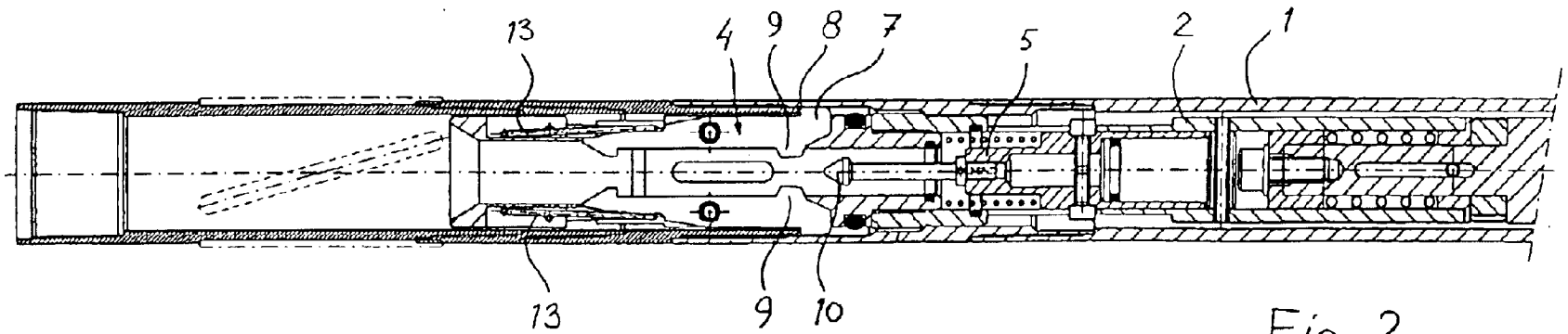
FIG. 2 shows a longitudinal section through a drill string provided with a locking device in accordance with the present invention, where the inner tube has assumed its correct position for drilling, and the flushing valve has been released.

When the inner tube with the locking device is inserted into the outer tube the forward, the outwardly directed protrusions 7 assume a retracted or compressed position and slide along the inside of the drill string. When the inner tube reaches the correct position inside the outer tube for drilling, as illustrated in FIG. 1, the protrusions 7 will be opposite the recesses 8 arranged in the outer tube and, thanks to the springs 13, can spring out and into abutment with the outer tube. The inner tube will thus be firmly held in relation to the outer tube. This state, with rebounded springs, is illustrated in FIG. 2. The recesses 8 in the outer tube are shaped with a shoulder or stop 14, against which the hook-shaped part of the protrusion can abut, thus preventing the inner tube from being withdrawn from the outer tube.

When the protrusions 7 and the entire portion of the locking device in front of the shafts 12 is permitted to rebound, the protrusions 9 will also move radially outwards so that the gripping means 10 connected to the movable part of the valve is released, and the valve 5 is thus also released. The movable part of the valve will therefore move, so that the valve is opened and flushing medium can flow freely into the inner tube. This is clear from FIG. 2.

Figure 3:
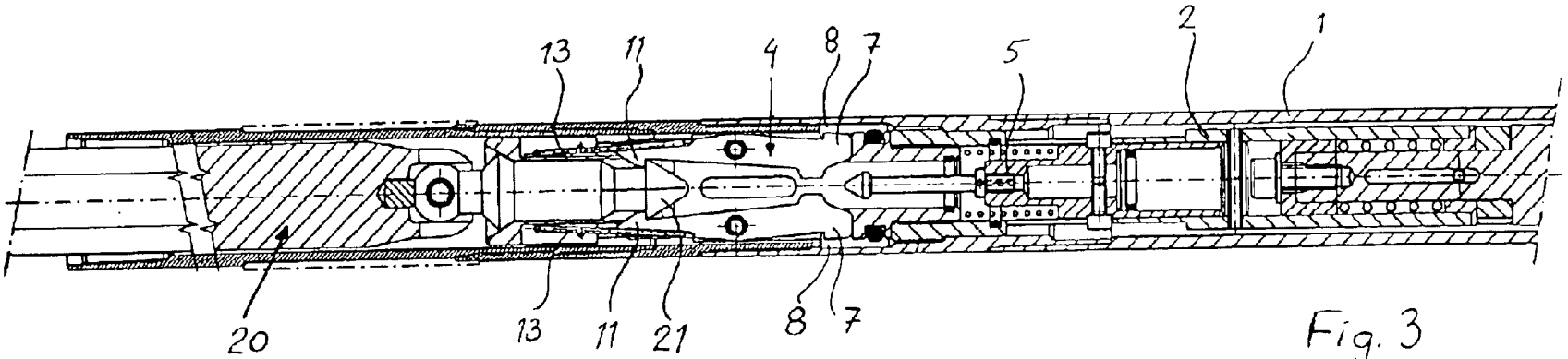
FIG. 3 shows a longitudinal section through a drill string provided with a locking device in accordance with the present invention, and illustrates how a retriever device is inserted into the locking device.

FIG. 3 illustrates how the locking device 4 functions when the inner tube is to be withdrawn. A retriever device 20, provided at the front with a gripping means 21, a spearhead, is inserted into the drill string. The gripping means 21 of the retriever device is so designed that, when it reaches the rear end of the locking device 4, it penetrates between the rear protrusions 11, pushing them apart, i.e. forcing them radially outwards against the action of the springs 13. The forward, outwardly directed protrusions 7 are thus moved radially inwards and become disengaged from the recesses 8 in the outer tube. The inner tube is now freely movable in axial direction. The gripping means 21 is inserted between the hook-shaped protrusions 11, so far that it engages therewith by abutting the hooks and is locked thereby. The inner tube can thus be freely removed from the outer tube by pulling the retriever device out. The valve 5 remains open throughout the withdrawal process, which is an advantage from the pressure aspect.

Figure 4:
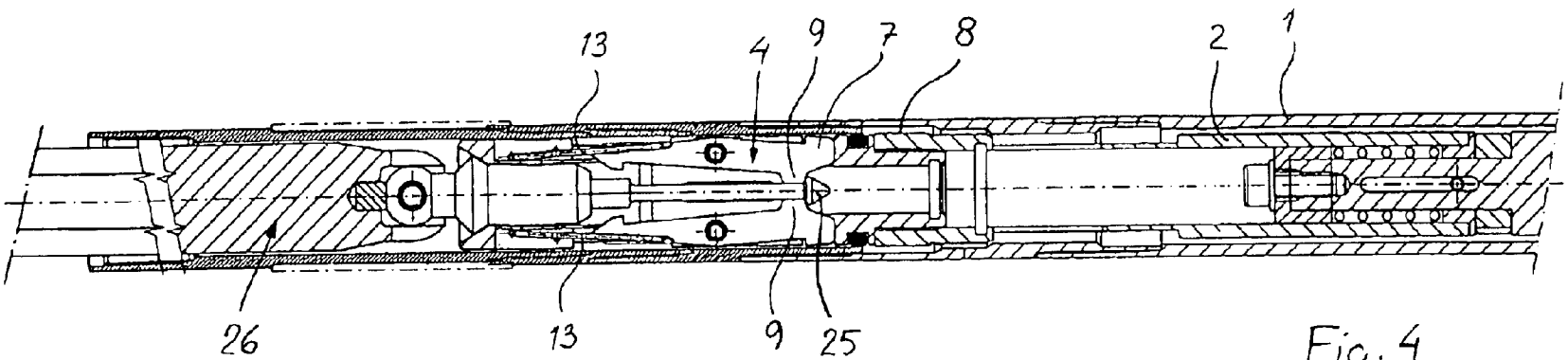
FIG. 4 shows a longitudinal section through drill string provided with a locking device in accordance with the present invention, where the inner tube is inserted into a dry drill hole.

Finally, FIG. 4 illustrates how the locking device 4 can also be used when inserting an inner tube into a dry drill hole. The forward, inwardly directed protrusions 9 which are used in FIGS. 1 and 2 to keep the gripping means 10 joined to the valve, are instead used here to grip around a gripping means 25 connected to a device 26 for insertion of an inner tube. FIG. 4 illustrates how the inner tube is inserted, before it has reached the correct position for drilling, i.e. before the protrusions 7 have arrived opposite the recesses 8 in the outer tube. The front portion of the locking device, with protrusions 7 and 9 is thus in its retracted position. When the inner tube comes to the position where the protrusions 7 are opposite the recesses 8, the front portion of the locking device will rebound in the same way as illustrated in FIG. 2, the protrusions 7 and 9 thus moving radially outwards. The gripping means 25 of the insertion device will thus be released and the insertion device can be withdrawn from the tube while the inner tube is kept in place in the outer tube, as described earlier.

The present invention is naturally not limited to the embodiment illustrated. It may be varied in many feasible ways within the scope of the appended claims. The number of parts may be varied, for instance, as well as the number of protrusions. In the example illustrated, furthermore, the two parts are provided with individual springs and are thus completely independent of each other. However, this is not necessary for the inventive concept.

What is claimed is:

1. A locking device for a wire line core drill comprising an inner tube by means of which core samples are collected, and an outer tube, which locking device is applied in the rear end of the inner tube wherein the locking device comprises locking members so designed that, when the inner tube has been inserted into the outer tube and has assumed the correct position inside the outer tube for drilling, in one and the same movement it simultaneously effects mechanical locking of the inner tube in relation to the outer tube and mechanical release of a gripping means of an accompanying device connected to the inner tube.

2. A locking device as claimed in claim 1 wherein the locking device also comprises gripping means that, when the inner tube is to be retracted from the outer tube with the aid of a retriever device comprising gripping means, and said gripping means of the retriever device come into contact with the gripping means of the locking device, in one and the same movement, shall engage with the gripping means of the retriever device and simultaneously release the inner tube from its locked position in relation to the outer tube.

3. A locking device as claimed in claim 2 wherein the gripping means of the locking device comprise at least two rear protrusions directed radially inwards.

4. A locking device as claimed in claim 2 wherein said locking device comprises at least two forward protrusions directed radially outwards and at least two forward protrusions directed radially inwards, said forward outwardly directed protrusions being intended to achieve locking of the inner tube in relation to the outer tube and said forward inwardly directed protrusions being intended to firmly lock the gripping means of the accompanying device during insertion into the outer tube, and to release the gripping means of the accompanying device when the inner tube has assumed its correct position in the outer tube for drilling.

5. A locking device as claimed in claim 4 wherein it comprises at least two parts, in that each of these parts comprises at least one of said protrusions, and in that each of said parts is journalled pivotably in the inner tube in radial direction about a shaft situated between the gripping means of the locking device and its forward protrusions so that the forward protrusions can pivot outwards in radial direction at the same time as the gripping means of the locking device can pivot inwards, and vice versa, whereupon the forward outwardly directed protrusions effect locking of the inner tube in relation to the outer tube by pivoting outwards through openings arranged in the inner tube and engage with recesses arranged on the inside of the outer tube, at the same time as the forward inwardly directed protrusions also pivot outwards and mechanically release the gripping means of the accompanying device when the inner tube has assumed the correct position in the outer tube for drilling.

6. A locking device as claimed in claim 5 wherein, in order to achieve retraction of the inner tube, the gripping means of the retriever device forces the gripping means of the locking device to pivot outwards so that they engage with the gripping means of the retriever device, and the forward protrusions thus pivot inwards so that the forward protrusions disengage with said recesses in the outer tube and thus release the inner tube from its locked position in relation to the outer tube.

7. A locking device as claimed in claim 6 wherein the gripping means of the locking device comprise at least two rear protrusions directed radially inwards.

8. A locking device as claimed in claim 6 wherein said inner tube of the wire line core drill is provided with a valve for flushing medium, said valve being comprised in the accompanying device, and in that said forward inwardly directed protrusions are designed to mechanically retain and mechanically release a gripping means connected to said valve, whereupon the valve is opened.

9. A locking device as claimed in claim 6 wherein said accompanying device is an insertion device for inserting an inner tube into an outer tube, which is provided with gripping means, and in that said forward inwardly directed protrusions are designed, in their inwardly pivoted position and during insertion of the inner tube into the outer tube, to be in engagement with the gripping means of said insertion device, and assumed their outwardly pivoted position when the inner tube has assumed the correct position inside the outer tube for drilling, whereupon the locking device is disengaged from the gripping means of the insertion device, so that said means can be removed together with its insertion device.

10. A locking device as claimed in claim 4 wherein said inner tube of the wire line core drill is provided with a valve for flushing medium, said valve being comprised in the accompanying device, and in that said forward inwardly directed protrusions are designed to mechanically retain and mechanically release a gripping means connected to said valve, whereupon the valve is opened.

11. A locking device as claimed in claim 4 wherein said accompanying device is an insertion device for inserting an inner tube into an outer tube, which is provided with gripping means, and in that said forward inwardly directed protrusions are designed, in their inwardly pivoted position and during insertion of the inner tube into the outer tube, to be in engagement with the gripping means of said insertion device, and assume their outwardly pivoted position when the inner tube has assumed the correct position inside the outer tube for drilling, whereupon the locking device is disengaged from the gripping means of the insertion device, so that said means can be removed together with its insertion device.

12. A locking device as claimed in claim 1 wherein said locking device comprises at least two forward protrusions directed radially outwards and at least two forward protrusions directed radially inwards, said forward outwardly directed protrusions being intended to achieve locking of the inner tube in relation to the outer tube and said forward inwardly directed protrusions being intended to firmly lock the gripping means of the accompanying device during insertion into the outer tube, and to release the gripping means of the accompanying device when the inner tube has assumed its correct position in the outer tube for drilling.

13. A locking device as claimed in claim 12 wherein it comprises at least two parts, in that each of these parts comprises at least one of said protrusions, and in that each of said parts is journalled pivotably in the inner tube in radial direction about a shaft situated between the gripping means of the locking device and its forward protrusions so that the forward protrusions can pivot outwards in radial direction at the same time as the gripping means of the locking device can pivot inwards, and vice versa, whereupon the forward outwardly directed protrusions effect locking of the inner tube in relation to the outer tube by pivoting outwards through openings arranged in the inner tube and engage with recesses arranged on the inside of the outer tube, at the same time as the forward inwardly directed protrusions also pivot outwards and mechanically release the gripping means of the accompanying device when the inner tube has assumed the correct position in the outer tube for drilling.

14. A locking device as claimed in claim 13 wherein said inner tube of the wire line core drill is provided with a valve for flushing medium, said valve being comprised in the accompanying device, and in that said forward inwardly directed protrusions are designed to mechanically retain and mechanically release a gripping means connected to said valve, whereupon the valve is opened.

15. A locking device as claimed in claim 12 wherein said inner tube of the wire line core drill is provided with a valve for flushing medium, said valve being comprised in the accompanying device, and in that said forward inwardly directed protrusions are designed to mechanically retain and mechanically release a gripping means connected to said valve, whereupon the valve is opened.

16. A locking device as claimed in claim 13 wherein said accompanying device is an insertion device for inserting an inner tube into an outer tube, which is provided with gripping means, and in that said forward inwardly directed protrusions are designed, in their inwardly pivoted position and during insertion of the inner tube into the outer tube, to be in engagement with the gripping means of said insertion device, and assume their outwardly pivoted position when the inner tube has assumed the correct position inside the outer tube for drilling, whereupon the locking device is disengaged from the gripping means of the insertion device, so that said means can be removed together with its insertion device.

17. A locking device as claimed in claim 12 wherein said accompanying device is an insertion device for inserting an inner tube into an outer tube, which is provided with gripping means, and in that said forward inwardly directed protrusions are designed, in their inwardly pivoted position and during insertion of the inner tube into the outer tube, to be in engagement with the gripping means of said insertion device, and assume their outwardly pivoted position when the inner tube has assumed the correct position inside the outer tube for drilling, whereupon the locking device is disengaged from the gripping means of the insertion device, so that said means can be removed together with its insertion device.

18. A method for wire line core drilling using a wire line core drill comprising an inner tube by means of which core samples are collected, and an outer tube, which inner tube is provided with a locking device to position the inner tube in the correct position in the outer tube for drilling, and to firmly lock the inner tube to the outer tube in said correct position by means of first locking members, wherein the inner tube is inserted into the outer tube, whereupon said first locking members are in a retracted position and second locking members of the locking device mechanically lock a gripping means of an accompanying device connected to the inner tube during insertion, until the inner tube has assumed the correct position in the outer tube, and when the inner tube has assumed the correct position inside the outer tube the locking device, in one and the same movement simultaneously effects mechanical locking of the inner tube to the outer tube and mechanical release of said gripping means of the accompanying device.

* * * * *